US006548165B2

(12) United States Patent
Yamakita et al.

(10) Patent No.: US 6,548,165 B2
(45) Date of Patent: Apr. 15, 2003

(54) REINFORCING TAPE FOR SLIDE FASTENER

(75) Inventors: Yoshimichi Yamakita, Uozu (JP); Mutsuo Hirota, Toyama-ken (JP); Kozo Watanabe, Kurobe (JP); Masanori Hirasawa, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/982,786

(22) Filed: Oct. 22, 2001

(65) Prior Publication Data

US 2002/0081427 A1 Jun. 27, 2002

(30) Foreign Application Priority Data

Oct. 30, 2000 (JP) ..... 2000-329856

(51) Int. Cl.[7] ..... B32B 27/34

(52) U.S. Cl. ..... 428/355 CN; 428/355 AC; 428/353; 428/354; 428/355 R

(58) Field of Search ..... 428/355 AC, 355 CN, 428/355 R, 353, 354

(56) References Cited

U.S. PATENT DOCUMENTS

| | | | | |
|---|---|---|---|---|
| 3,490,970 A | | 1/1970 | Heimberger | |
| 3,663,996 A | | 5/1972 | Heimberger et al. | |
| 4,651,389 A | | 3/1987 | Yoshida et al. | |
| 4,922,584 A | | 5/1990 | Funakawa et al. | |
| 5,231,737 A | | 8/1993 | Fröhlich et al. | |
| 5,728,460 A | | 3/1998 | Hirasawa et al. | |
| 6,093,489 A | * | 7/2000 | Watanabe | 428/349 |

FOREIGN PATENT DOCUMENTS

| | | |
|---|---|---|
| JP | 44-25843 | 10/1969 |
| JP | 62-149780 | 7/1987 |

* cited by examiner

*Primary Examiner*—Margaret G. Moore
*Assistant Examiner*—Christopher M. Keehan
(74) *Attorney, Agent, or Firm*—Finnegan, Henderson, Farabow, Garrett, & Dunner, L.L.P.

(57) ABSTRACT

A reinforcing tape for a slide fastener comprises a polyamide elastomer film manifesting a modulus of elasticity in bending in the range of 6,000 to 9,000 kg/cm$^2$ and an adhesive layer. In a preferred embodiment, a polyester hot-melt adhesive is used for the adhesive layer. Preferably an intermediate layer having a thickness thinner than the thickness of the polyamide elastomer film and that of the adhesive layer is interposed between the polyamide elastomer film and the adhesive layer. In this case, a polyester anchor coat agent is used for the intermediate layer.

7 Claims, 2 Drawing Sheets

REINFORCING TAPE FOR SLIDE FASTENER

BACKGROUND OF THE INVENTION

1. Field of the Invention

This invention relates to a reinforcing tape or reinforcing sheet material to be attached to the end portion of a fastener tape which is intended for allowing attachment of a pin-and-socket separator.

2. Description of the Prior Art

The reinforcing tapes to be attached to the end portions of fastener tapes have been heretofore known in various types. The conventional reinforcing tapes include those which, for the sake of obviating the necessity of preparing reinforcing tapes dyed specially in various colors matched to the colors of dyed fastener tapes and consequently saving such time and labor as would otherwise be incurred in the inventory control, use transparent synthetic resin films in a superposed manner so as to show the colors of the dyed fastener tapes therethrough. For example, the reinforcing piece which is formed of two superposed transparent synthetic resin films having different melting points and is adapted to be applied fast to a fastener tape by melting that of the two films having a lower melting point as disclosed in Japanese Utility Model Publication No. (hereinafter referred to briefly as "JUM-B-") 44-25,843 and the lateral application tape which is formed by superposing on one side of a transparent film of nylon 6 or nylon 66 a transparent polyester copolymer film having a melting point of not more than 200° C. so as to show the color of the base fabric of the fastener tape therethrough as disclosed in published Japanese Patent Application, KOKAI (Early Publication) No. (hereinafter referred to briefly as "JP-A-") 62-149,780 have been known to the art.

Since the reinforcing tapes formed of two layers of synthetic resin film as are disclosed in JUM-B-44-25,843 and JP-A-62-149,780 mentioned above are hard from the material point of view, they cannot be easily shaped by bending in conformity with the shape of the core portion of the fastener tape intended for permitting attachment of a pin-and-socket separator and, for this reason, the core portion of the fastener tape is not easily formed accurately in contour thereof. Further, these reinforcing tapes have the problem that when they are repeatedly bent, the bent lines thereof ultimately cause whitening possibly to the extent of jeopardizing the appearance of the reinforcing tapes.

To solve such problems, JP-A-8-299,033 and JP-A-10-306,262 filed by the assignee of this application propose reinforcing tapes using a transparent polyester elastomer film as a surface layer and having an adhesive layer superposed on the reverse side thereof.

SUMMARY OF THE INVENTION

The reinforcing tapes disclosed in JP-A-8-299,033 and JP-A-10-306,262 mentioned above have the surface layer (reinforcing layer) thereof formed of a polyester elastomer film and, therefore, enjoy the advantage of possessing flexibility enough to be folded in conformity with the contour of the core portion of the fastener tape as compared with the aforementioned reinforcing tape formed of synthetic resin film.

When the elastomer film is used for the reinforcing layer and this film happens to be supple, excellent in transparency and soft, however, it is at a disadvantage that the reinforcing tape will be easily stained by a dry cleaning liquid when it is somewhat muddy. Further, since the film is deficient in resistance to washing and resistance to dry cleaning, the goods having fastener tapes attached thereto, on being washed or dry cleaned, encounter the problem that the reinforcing tape readily swells and the peel strength between the reinforcing tape and the fastener tape is degraded to the extent of rendering the reinforcing tape easy to peel. Moreover, the slide fastener using a polyester elastomer film is somewhat inferior to that using a polyamide elastomer film in their strength, uniformity of color with the fastener tape, flexing resistance, cold temperature resistance, and light-fastness.

It is, therefore, an object of the present invention to provide a reinforcing tape for a slide fastener, which excels in stain resistance to a dry cleaning liquid and exhibits high peel strength between the reinforcing tape and the fastener tape, while maintaining advantages of the elastomer film as the reinforcing layer of possessing suppleness and excellent transparency.

Another object of the present invention is to provide a reinforcing tape for a slide fastener, which possesses good resistance to washing and to dry cleaning and stain resistance in combination with high strength, flexing resistance, cold temperature resistance, and light-fastness.

To accomplish the objects mentioned above, the present invention provides a reinforcing tape for a slide fastener, which tape is characterized by comprising in combination a polyamide elastomer film manifesting a modulus of elasticity in bending in the range of 6,000 to 9,000 kg/cm$^2$ and an adhesive layer.

In a preferred embodiment of the present invention, a polyester-based hot-melt adhesive is used for the adhesive layer.

In another preferred embodiment of the present invention, an intermediate layer is interposed between the polyamide elastomer film and the adhesive layer, wherein the intermediate layer has a thickness thinner than the thickness of the elastomer film and that of the adhesive layer. In this case, a polyester-based anchor coat agent is advantageously used for the intermediate layer.

Since the reinforcing tape of the present invention uses as a reinforcing layer the polyamide elastomer film manifesting a modulus of elasticity in bending in the range of 6,000 to 9,000 kg/cm$^2$ as mentioned above, it excels in stain resistance to a dry cleaning liquid and possesses good resistance to washing and to dry cleaning and stain resistance in combination with high strength, flexing resistance, cold temperature resistance, and light-fastness, while maintaining advantages of the elastomer film as the reinforcing layer of possessing suppleness and excellent transparency. Further, by interposing a relatively very thin intermediate layer between the polyamide elastomer film and the adhesive layer to improve the interlaminar strength thereof, it is possible to increase the peel strength between the reinforcing tape and the fastener tape and improve the resistance to washing and to dry cleaning and the stain resistance. By bonding the reinforcing tape of the construction described above to the end portion of a fastener tape through the medium of the adhesive layer, particularly a polyester hot-melt adhesive layer, the fastener tape is enabled to acquire a reinforced part having the reinforcing tape joined thereto with thorough adhesive strength. Further, since the reinforcing tape of the present invention is transparent or translucent and excels in flexibility, it can be easily shaped in perfect conformity with the contour of the core portion of the fastener tape. When it is repeatedly folded, the folded portion is not whitened. Furthermore, when it is fixed to the fastener tape, it allows the color of the fastener tape to be directly seen therethrough and will not impair the appearance of the fastener tape.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENTS

Figure 1:
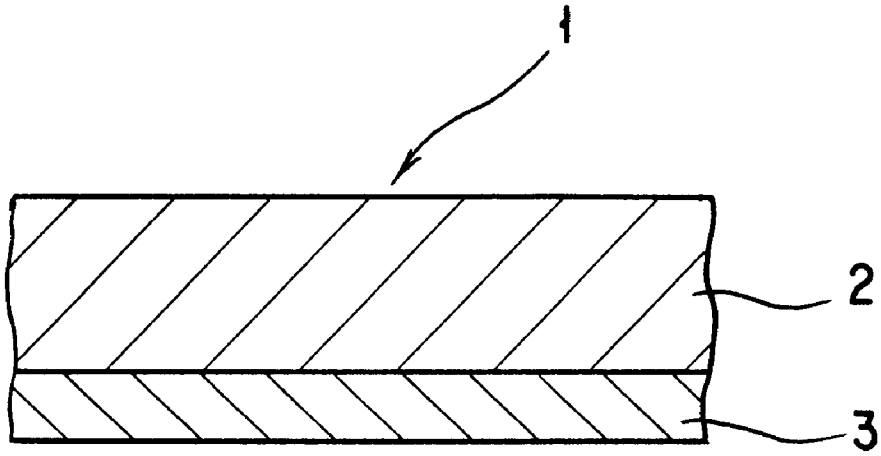
FIG. 1 is a fragmentary cross-sectional view schematically illustrating an embodiment of a reinforcing tape of the present invention.

The use of a transparent elastomer film such as a polyester elastomer film for a reinforcing layer of a reinforcing tape has been already known as described above. When the elastomer film is used for the reinforcing layer and this film happens to be supple, excellent in transparency, and soft, however, it is at a disadvantage that the reinforcing tape will be easily stained by a dry cleaning liquid when it is somewhat muddy. Further, since the film is deficient in resistance to washing and in resistance to dry cleaning, the reinforcing tape is at a disadvantage in readily swelling after washing or dry cleaning and the peel strength between the reinforcing tape and the fastener tape is degraded to the extent of rendering the reinforcing tape easy to peel. When an elastomer film of high rigidity is used instead for the purpose of improving the resistance to dry cleaning, workability, and strength, however, since the rigidity is unduly high, the produced reinforcing tape has the disadvantage of encountering difficulty in shaping the tape as folded in conformity with the contour of the core portion of the fastener tape and suffering degradation of transparency. In the actual product, therefore, a nylon film or plain weave fibers are used for the reinforcing layer. It has been still difficult to put the reinforcing tape using an elastomer film to practical use.

The present inventors have found that such contradicting merits and demerits of the elastomer film as mentioned above can be finely reconciled by using a polyamide elastomer film as a reinforcing layer of the reinforcing tape and defining its modulus of elasticity in bending to a specific range, i.e. from 6,000 to 9,000 kg/cm$^2$.

A soft polyamide elastomer film having a modulus of elasticity in bending lower than the above range will be easily stained by a dry cleaning liquid when it is somewhat muddy, as mentioned above, and will be deficient in resistance to dry cleaning and in strength to resist a lateral pull exerted on a pin-and-socket separator because of a small crystal content. Conversely, a polyamide elastomer film having a modulus of elasticity in bending exceeding the above range will be deficient in transparency and flexibility because of an unduly high crystal content. When the polyamide elastomer film having a modulus of elasticity in bending in the above range is used for the reinforcing layer, it allows manufacture of a reinforcing tape for a slide fastener, which is transparent, excels in stain resistance to a dry cleaning liquid, and possesses highly satisfactory resistance to washing and to dry cleaning in combination with high strength. Furthermore, the slide fastener using the polyamide elastomer film is advantageous in comparison with that using a polyester elastomer film in view of their strength, uniformity of color with the fastener tape, flexing resistance, cold temperature resistance, and light-fastness.

Furthermore, in the reinforcing tape for a slide fastener comprising the transparent polyamide elastomer film and the adhesive layer superposed on the reverse side thereof as mentioned above, when a relatively very thin intermediate layer is interposed between the polyamide elastomer film and the adhesive layer mentioned above for the purpose of improving the interlaminar strength thereof, particularly when a polyester-based anchor coat agent is used for the intermediate layer and a polyester-based hot-melt adhesive is used for the adhesive layer, the peel strength between the reinforcing tape and the fastener tape is further increased and the reinforcing tape for a slide fastener excelling in resistance to washing and to dry cleaning and in strain resistance can be obtained.

Now, the present invention will be described more specifically below with reference to the preferred embodiments which are illustrated in the annexed drawings.

FIG. 1 illustrates one example of the construction of a reinforcing tape 1 according to the present invention. The reinforcing tape 1 is constructed by superposing an adhesive layer 3 on the reverse side of a transparent polyamide elastomer film 2. As the polyamide elastomer film 2, the polyamide elastomer film having the modulus of elasticity in bending in the range of from 6,000 to 9,000 kg/cm$^2$ is used as mentioned above.

Such reinforcing tape 1 may be superposed on not only one side of the fastener tape but also on both sides of the fastener tape. Generally, it is made on both the obverse and the reverse side.

The thickness of the polyamide elastomer film 2 is proper generally in the range of 50 to 200 $\mu$m, preferably in the approximate range of 80 to 120 $\mu$m.

On the other hand, the thickness of the adhesive layer 3 is proper generally in the range of 30 to 120 $\mu$m, preferably in the range of 50 to 60 $\mu$m.

Incidentally, though the modulus of elasticity in bending of the reinforcing tape in its entirety hinges heavily on the modulus of elasticity in bending of the polyamide elastomer film itself because the adhesive layer (or further the intermediate layer to be described hereinafter) of the reinforcing tape have a small thickness and low rigidity as compared with the polyamide elastomer film as the reinforcing layer, it is affected by the kind, thickness, etc. of the adhesive layer. It is, therefore, preferable for the kind, thickness, etc. of the adhesive layer to be selected such that the modulus of elasticity in bending of the reinforcing tape in its entirety falls in the aforementioned range.

For the adhesive layer 3, various adhesive agents which have been heretofore known as suitable for the reinforcing tape can be used. The adhesive agent does not need to be limited to any specific kind. It is, however, preferred to be a hot-melt adhesive having affinity for the material of the fastener tape, particularly a hot-melt adhesive using resin of the same type as the raw material of the fastener tape. When the material of the fastener tape is polyester fibers, for example, the polyester hot-melt adhesive having as the base polymer thereof a transparent polyester copolymer can be advantageously used. Particularly when a polyester-based anchor coat agent is used for the intermediate layer to be described hereinafter, it is preferable to use the polyester hot-melt adhesive from the viewpoint of adhesive strength. On the other hand, when the material of the fastener tape is nylon, the polyamide hot-melt adhesive having as the base polymer thereof a low melting transparent nylon copolymer of at least three components obtained by copolymerizing such monomers as nylon 6, nylon 66, nylon 610, and nylon 612 may also be used.

Among other hot-melt adhesives, as disclosed in JP-A-10-295418, the hot-melt adhesives manifesting a melting point in the range of 110° to 120° C. and a melt viscosity at 200° C. in the range of 1,000 to 2,000 poises prove to be particularly desirable from the following reasons. When such a hot-melt adhesive is used for the adhesive layer of the reinforcing tape, it easily melts during the attachment of the reinforcing tape to the fastener tape by simultaneous application of heat and pressure and easily penetrates the interstices of the fibers of the fastener tape, and the resin which is present between the fibers manifests a high anchoring effect after cooling and hardening. As a result, a product which is furnished with the fastener tape having its end portion reinforced as described above, therefore, maintains high peel strength between the reinforcing tape and the fastener tape even after the product has been washed or dry cleaned.

Figure 2:
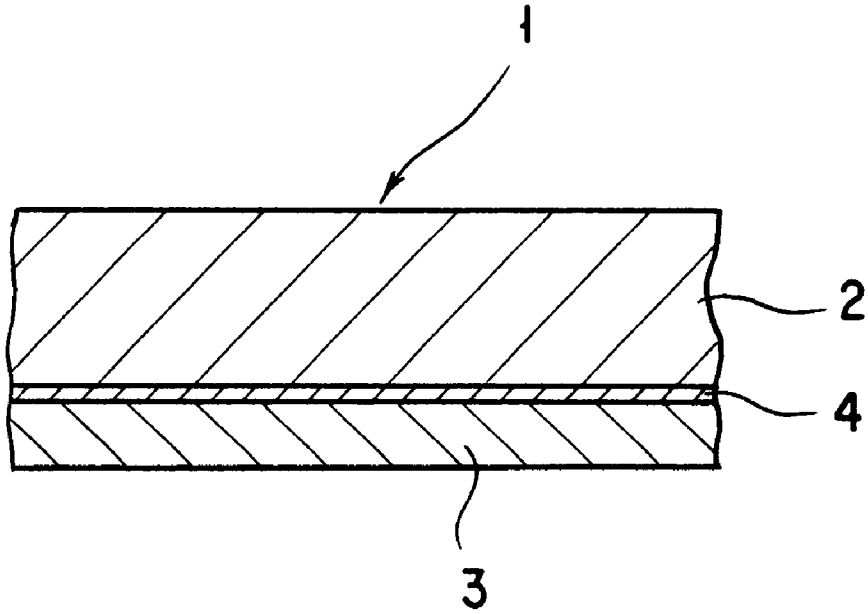
FIG. 2 is a fragmentary cross-sectional view schematically illustrating another embodiment of the reinforcing tape of the present invention.

FIG. 2 illustrates another example of the construction of the reinforcing tape 1 according to the present invention. The reinforcing tape 1 is constructed by superposing the adhesive layer 3 on the reverse side of the transparent polyamide elastomer film 2 through the medium of a relatively very thin intermediate layer 4.

For the intermediate layer 4, a polyester-based anchor coat agent comprising a copolymeric polyester or the like may be advantageously used. The thickness of the intermediate layer 4 is proper generally in the range of 0.5 to 10 $\mu$m, preferably in the approximate range of 2 to 3 $\mu$m.

The reinforcement of the end portion of the fastener tape may be carried out by applying the adhesive layer to the surface of the end portion of the fastener tape, then superposing the reinforcing layer comprising the polyamide elastomer film or the polyamide elastomer film covered with the intermediate layer on the adhesive layer, and joining the superposed layers by simultaneous application of heat and pressure. For the purpose of precluding the entry of bubbles between the adhesive layer and the reinforcing layer during the step of attachment, however, it is effected preferably by a procedure which comprises previously preparing the reinforcing tape having the elastomer film coated on one side thereof with the adhesive layer (or the intermediate layer and the adhesive layer in sequence) by the known technique of superposition such as, for example, the dry laminating technique or coextruding technique and bonding this reinforcing tape to the surface of the end portion of the fastener tape through the medium of the adhesive layer by simultaneous application of heat and pressure. As the heating method in the simultaneous application of heat and pressure, such heating means as a hot plate, ultrasonic wave, or high frequency are available.

Figure 3:
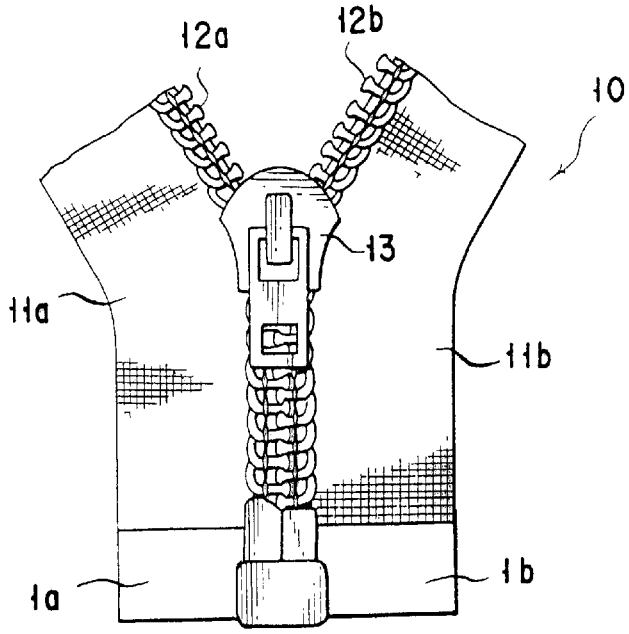
FIG. 3 is a fragmentary plan view showing the lower part of a slide fastener provided with reinforcing tapes of the present invention.
Figure 4:
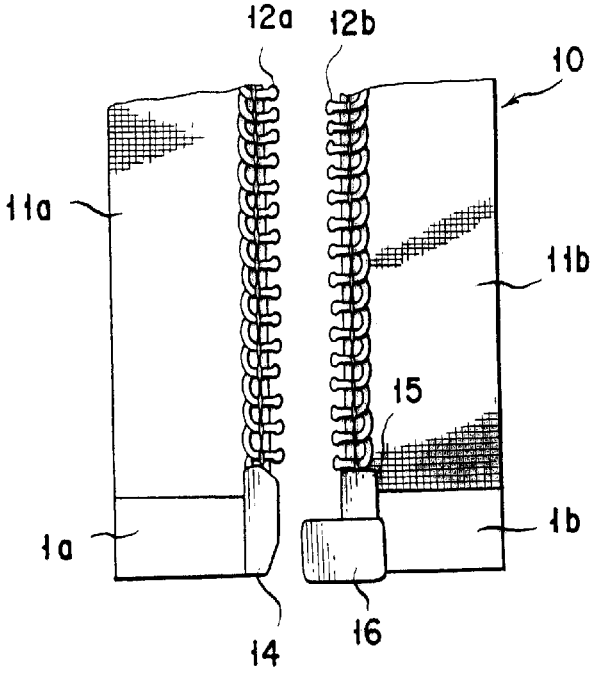
FIG. 4 is a fragmentary plan view showing the lower part of the slide fastener of FIG. 3 held in a separated state.

FIG. 3 and FIG. 4 each show the lower part of one embodiment of a slide fastener 10 having the reinforcing tapes 1*a* and 1*b* of the present invention provided at the lower end portions of a pair of fastener tapes 11*a* and 11*b* to which members of a pin-and-socket separator are attached.

The slide fastener 10 shown in FIG. 3 includes a pair of fastener tapes 11*a* and 11*b,* a pair of reinforcing tapes 1*a* and 1*b* which are welded or bonded to the lower end portions of the respective fastener tapes 11*a* and 11*b,* rows of coupling elements 12*a* and 12*b,* such as spiral coil coupling elements, attached to the inner longitudinal edges of the respective fastener tapes, a slider 13, and a pin-and-socket separator composed of an insertion member or butterfly bar 14, a box bar 15, and a box member 16, these members being secured to the inner edges of the reinforcing tapes 1*a* and 1*b* which are welded to the lower end portions of fastener tapes 11*a* and 11*b*. The slider 13 is slidably mounted on the rows of coupling elements 12*a* and 12*b* for engaging and disengaging the coupling elements 12*a* and 12*b*. FIG. 3 shows the slide fastener 10 in a closed state and FIG. 4 shows it in an opened state.

The fastener tapes 11*a* and 11*b* are manufactured by weaving or knitting a fibrous material formed of such synthetic fibers as polyester, nylon, etc. or such natural fibers as cotton. To the lower end portions of the pair of fastener tapes 11*a* and 11*b,* the reinforcing tapes 1*a* and 1*b* are respectively welded or bonded through the medium of the adhesive layer as explained hereinbefore. The butterfly bar 14 which is one of the fitting metal pieces for the pin-and-socket separator is secured to the inner edge of one, 1*a,* of the opposed reinforcing tapes and the box member 16 for admitting the butterfly bar 14 and the box bar 15 therefor are secured to the opposite inner edge of the other, 1*b,* of the reinforcing tapes. The butterfly bar 14 is releasably engageable in a slot in the box member 16. The box member 16 and the box bar 15 are integrally molded as one piece.

In the manner described above, the end portions of the fastener tapes 11*a* and 11*b* are reinforced by the application thereto with high adhesive strength of the reinforcing tapes 1*a* and 1*b* of the present invention possessing such transparency or translucency as to allow the color of the fastener tapes to be seen therethrough and excelling in flexibility. Since the reinforcing tapes 1*a* and 1*b* are nearly transparent as a whole, they allow the color of the fastener tapes 11*a* and 11*b* to be directly seen therethrough. Since the reinforcing tapes appear in essentially the same color as the dyed fastener tapes, they will not impair the appearance of the fastener tapes. Further, since the reinforcing tape of one kind can be applied to fastener tapes of varying colors, it is at the advantage that there is no need to prepare the reinforcing tapes in various kinds elaborately adapted to fit such varying colors and no use for any complicated management of storage. For the purpose of allaying the surface gloss of the reinforcing tape or augmenting the flexibility thereof, the reinforcing layer in the surface of the reinforcing tape may be knurled after or during the application of heat and pressure.

Now, the present invention will be described more concretely below with reference to a working example, a comparative example and a test example which have confirmed the effect of the present invention specifically.

EXAMPLE 1

A reinforcing tape was prepared by laminating a polyester hot-melt adhesive layer of 60 $\mu$m thickness (product of Toyo Boseki K.K. marketed under the trade name of "Byron GM900") on the reverse side of a nylon elastomer film of 120 $\mu$m thickness (product of ATOCHEM Inc., modulus of elasticity in bending: 7,500 kg/cm$^2$).

COMPARATIVE EXAMPLE 1

A reinforcing tape was prepared by laminating a polyester hot-melt adhesive layer of 60 $\mu$m thickness (product of Toyo Boseki K.K. marketed under the trade name of "Byron GM900") on the reverse side of a nylon elastomer film of 120 μm thickness (product of ATOCHEM Inc., modulus of elasticity in bending: 2,000 kg/cm$^2$).

TEST EXAMPLE 1

Each of the reinforcing tapes prepared in Example 1 and Comparative Example 1 mentioned above was subjected to the measurement of the strength to resist lateral pull (transverse tensile strength) of a pin-and-socket separator and the strength to resist longitudinal pull of a box part thereof.

Samples were manufactured by superposing each of the reinforcing tapes prepared in Example 1 and Comparative Example 1 mentioned above in the lateral direction on the obverse and the reverse side of a slide fastener having the coupling elements thereof in a meshed state such that the adhesive layers contacted the surfaces and intersected the rows of coupling elements and then bonding the reinforcing tapes to the slide fastener by ultrasonic heating under pressure. The ultrasonic adhesion was carried out by the use of a 40-kHz ultrasonic wave oscillator, with the air pressure set at 3.5 kg/cm$^2$, the temperature of the die heater at 40° C., and the welding energy at 9 kJ.

The strength test was carried out as follows. Reinforcing tapes 20*a* and 20*b* were attached to the end portions of fastener tapes 11*a* and 11*b* and a pin-and-socket separator composed of a butterfly bar 14, box bar 15, and box member 16 and disposed in the ends of the rows of coupling elements 12*a* and 12*b* of the fastener tapes was put into a closed state as illustrated in FIG. 3. A pair of laterally opposed grippers were caused to nip the laterally opposed fastener tapes in the attached part of the reinforcing tape and the grippers were moved laterally relative to the fastener tapes (in the direction of forcing the grippers away from each other) or in the longitudinal direction to give a lateral pull (the strength to resist lateral pull) or longitudinal pull (the strength to resist longitudinal pull) to the laterally opposed fastener tapes and the load produced separation of the pin-and-socket separator was recorded. This procedure was performed up to five repetitions and the maximum value, the minimum value, and the average of the five measurements were obtained. The results are shown in Table 1. Incidentally, the specified value for the strength to resist lateral pull (transverse tensile strength) of a pin-and-socket separator is 12.0 kg and over and that for the strength to resist longitudinal pull of a box part thereof is 9.0 kg and over.

TABLE 1

| Characteristics | | Example 1 | Comparative Example 1 |
|---|---|---|---|
| Strength to resist lateral pull of a pin-and-socket separator (kg) | Average | 16.7 | 13.4 |
| | Maximum | 18.1 | 15.5 |
| | Minimum | 15.5 | 9.7 |
| Strength to resist longitudinal pull of a box part (kg) | Average | 14.5 | 14.0 |
| | Maximum | 16.8 | 15.8 |
| | Minimum | 12.4 | 13.1 |

It is clearly noted from the results shown in Table 1 that there was not found so significant difference in the strength to resist longitudinal pull between Example 1 and Comparative Example 1, but the strength to resist lateral pull of the sample of Example 1 which used the nylon elastomer film having the modulus of elasticity in bending of 7,500 kg/cm$^2$ was considerably higher than that of the sample of Comparative Example 1 which used the nylon elastomer film having the modulus of elasticity in bending of 2,000 kg/cm$^2$.

EXAMPLE 2

A reinforcing tape was prepared by applying a polyester-based anchor coat agent to the reverse side of a nylon elastomer film of 120 μm thickness (product of ATOCHEM Inc., modulus of elasticity in bending: 7,500 kg/cm$^2$) so as to form a coating of 2 to 3 μm thickness and further laminating a polyester hot-melt adhesive layer of 60 μm thickness (product of Toyo Boseki K.K. marketed under the trade name of "Byron GM900") on the formed coating.

TEST EXAMPLE 2

By following the procedure of Test Example 1 mentioned above, samples were manufactured by superposing each of the reinforcing tapes prepared in Example 2 and Comparative Example 1 mentioned above on the obverse and the reverse side of a slide fastener having the coupling elements thereof in a meshed state and then bonding the reinforcing tapes to the slide fastener by ultrasonic heating under pressure.

After the adhesion, each of the samples was washed five times or twenty times and dry cleaned five times or twenty times and then tested for peel strength.

The washing was performed up to five or twenty repetitions by following the Method A-4 for washing test specified in JIS (Japanese Industrial Standard) L 0844 "Testing Methods for Color Fastness to Washing and Laundering." The dry cleaning was performed by carrying out up to five or twenty repetitions the series of steps of washing a given sample for three minutes at room temperature in a detergent produced by dissolving soap in perchloroethylene, rinsing the washed sample with perchloroethylene twice each for three minutes, draining the rinsed sample by high-speed rotation for three minutes and meanwhile treating it by the use of an instrument sold under the trademark designation of "Spraymatic" (for the sake of preventing static electrification, conferring soft finish, and furnishing protection against microbe and odor), then drying the treated sample at 70° C. for 15 minutes, and further gradually cooling and drying it for five minutes.

The peel strength of a given sample was determined by dividing the reinforcing tape in the sample into two halves along a cut inserted in the center of the meshed coupling elements and peeling the right half of the reinforcing tape from the sample by pulling the right cut edge up and meanwhile measuring the strength required for peeling. The peel strength was determined on both obverse and reverse surface of the sample.

The results are shown in Table 2.

TABLE 2

| Peel Strength | | | Example 2 | Comparative Example 1 |
|---|---|---|---|---|
| Washing | 5 times | Obverse | ⊙ | ○ |
| | | Reverse | ⊙ | ○ |
| | 20 times | Obverse | ⊙ | ○ |
| | | Reverse | ⊙ | Δ |
| Dry Cleaning | 5 times | Obverse | ⊙ | X*) |
| | | Reverse | ⊙ | X*) |
| | 20 times | Obverse | ⊙ | X*) |
| | | Reverse | ⊙ | X*) |

Remarks

TABLE 2-continued

| Peel Strength | Example 2 | Comparative Example 1 |
|---|---|---|

◎: There was a slight deviation in strength and thus evaluated as good.
○: Although the measured values were within the specified range (1.0 kg/cm and over), deviation in the values was found.
Δ: Some measured values were not within the specified range.
X: The average value was outside the specified range.
*): The boundary peeling had already occurred after the dry cleaning treatment.

It is clear from the results shown in Table 2 that the peel strength of the sample of Example 2 which used the intermediate layer was higher than that of the sample of Comparative Example 1 which used no intermediate layer invariably after the adhesion, after five or twenty rounds of washing, and after five or twenty rounds of dry cleaning. Incidentally, the specified value for the peel strength is 1.0 kg/cm and over for both after washing and after dry cleaning.

While certain specific embodiments and working examples have been disclosed herein, the invention may be embodied in other specific forms without departing from the spirit or essential characteristics thereof. The described embodiments and working examples are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

The disclosure in Japanese Patent Application No. 2000-329856 of Oct. 30, 2000 is incorporated here by reference. This Japanese Patent Application describes the invention described hereinabove and claimed in the claims appended hereinbelow and provides the basis for a claim of priority for the instant invention under 35 U.S.C. 119.

What is claimed is:

1. A reinforcing tape for a slide fastener, comprising in combination:

a polyamide elastomer film manifesting a modulus of elasticity in bending in the range of 6,000 to 9,000 kg/cm$^2$ and an adhesive layer.

2. The reinforcing tape according to claim 1, wherein said adhesive layer is formed of a polyester hot-melt adhesive.

3. The reinforcing tape according to claim 1, wherein said polyamide elastomer film has a thickness in the range of 50 to 200 $\mu$m and said adhesive layer has a thickness in the range of 30 to 120 $\mu$m.

4. The reinforcing tape according to claim 1, wherein said adhesive layer is formed of a hot-melt adhesive having a melting point in the range of 110° to 120° C. and a melt viscosity at 200° C. in the range of 1,000 to 2,000 poises.

5. The reinforcing tape according to claim 1, further comprising an intermediate layer interposed between said polyamide elastomer film and said adhesive layer and having a thickness thinner than the thickness of said polyamide elastomer film and the thickness of said adhesive layer.

6. The reinforcing tape according to claim 5, wherein said intermediate layer is formed of a polyester anchor coat agent.

7. The reinforcing tape according to claim 5, wherein said intermediate layer has a thickness in the range of 0.5 to 10 $\mu$m.

* * * * *